US010829977B2

(12) United States Patent
Bernhagen et al.

(10) Patent No.: US 10,829,977 B2
(45) Date of Patent: Nov. 10, 2020

(54) POWERED SLIDING DOOR OPERATOR

(71) Applicant: Pella Corporation, Pella, IA (US)

(72) Inventors: Todd Bernhagen, Pella, IA (US); Paul Schroder, Pella, IA (US); Evan Vande Haar, Pella, IA (US)

(73) Assignee: Pella Corporation, Pella, IA (US)

( * ) Notice: Subject to any disclaimer, the term of this patent is extended or adjusted under 35 U.S.C. 154(b) by 78 days.

(21) Appl. No.: 15/786,383

(22) Filed: Oct. 17, 2017

(65) Prior Publication Data

US 2018/0106090 A1 Apr. 19, 2018

Related U.S. Application Data

(60) Provisional application No. 62/409,539, filed on Oct. 18, 2016.

(51) Int. Cl.
*E05F 15/641* (2015.01)

(52) U.S. Cl.
CPC ..... *E05F 15/641* (2015.01)

(58) Field of Classification Search
CPC ..... E05F 15/641
See application file for complete search history.

(56) References Cited

U.S. PATENT DOCUMENTS 1,198,138 A 9/1916 Lovell
1,325,790 A 12/1919 Kleinschmidt
1,494,948 A 5/1924 Bujack
4,065,878 A * 1/1978 Tsugane ..... E05F 15/641 49/360
4,120,072 A 10/1978 Hormann
4,675,938 A 6/1987 Bundschuh
4,723,374 A * 2/1988 Peterson ..... E06B 11/045 49/394
4,738,052 A 4/1988 Yoshida
4,893,435 A 1/1990 Shalit
4,913,214 A * 4/1990 Ming ..... E06B 9/36 160/168.1 P
4,998,577 A * 3/1991 Kobayashi ..... E05D 15/0608 160/197
5,136,813 A * 8/1992 Gibbs ..... E05D 15/0617 49/404
5,144,770 A 9/1992 Kraus et al.
5,351,441 A 10/1994 Hormann
5,502,925 A 4/1996 Gorrell
5,566,505 A * 10/1996 Kamezaki ..... E05D 15/1021 49/209
5,623,784 A 4/1997 Kuersten et al.
(Continued)

FOREIGN PATENT DOCUMENTS

CA 2679116 A1 3/2010
DE 202012000232 U1 * 4/2013 ..... E05D 15/565
(Continued)

*Primary Examiner* — Catherine A Kelly
(74) *Attorney, Agent, or Firm* — Faegre Drinker Biddle & Reath LLP

(57) ABSTRACT

Various aspects of the present disclosure are directed toward apparatuses, systems, and methods for operating a fenestration assembly having a vent panel. The apparatuses, systems, and methods may include an actuator having an engagement section configured to contact a horizontal portion of the fenestration assembly and a drive assembly configured to actuate the engagement section.

22 Claims, 13 Drawing Sheets

(56) References Cited

U.S. PATENT DOCUMENTS 5,656,898 A 8/1997 Kalina
5,682,710 A 11/1997 Davies et al.
5,687,506 A 11/1997 Davies et al.
5,711,112 A 1/1998 Barten et al.
5,813,171 A 9/1998 Piltingsrud
5,815,984 A 10/1998 Sheets et al.
5,815,987 A * 10/1998 Beasley ..... E04B 1/346 52/65
5,826,377 A 10/1998 Simson et al.
5,845,363 A 12/1998 Brempell et al.
5,852,897 A 12/1998 Sukale
5,884,361 A 3/1999 Richardson et al.
6,139,070 A 10/2000 Piltingsrud
6,209,610 B1 4/2001 Davies et al.
6,267,168 B1 7/2001 Davies et al.
6,314,681 B1 11/2001 Moody
6,343,436 B1 2/2002 Milano et al.
6,449,906 B1 * 9/2002 Jacobs ..... E05D 15/0691 49/409
6,490,832 B1 12/2002 Fischbach et al.
6,543,581 B1 4/2003 Durand et al.
6,553,717 B2 4/2003 St. John et al.
6,581,332 B1 * 6/2003 Kim ..... E05F 15/77 49/358
6,595,889 B2 7/2003 Minegishi et al.
6,679,002 B2 1/2004 Davies et al.
6,679,186 B2 1/2004 Prevost
6,895,718 B2 5/2005 Moffatt
6,918,210 B1 7/2005 Smiley
7,013,604 B1 3/2006 Moody et al.
7,237,811 B1 7/2007 Lawrence
7,703,242 B2 4/2010 Goebel et al.
7,708,322 B2 5/2010 Timothy et al.
7,770,943 B2 8/2010 Kaiser
7,992,346 B2 8/2011 Finke
8,109,040 B2 2/2012 Finke
8,240,089 B2 8/2012 Lambertini
8,365,470 B1 2/2013 Campbell et al.
8,434,265 B1 5/2013 Campbell et al.
8,474,185 B2 7/2013 Busch
8,572,896 B2 11/2013 Busch
8,595,977 B2 12/2013 Hancock et al.
8,745,925 B2 * 6/2014 Halfon ..... E05F 17/00 49/358
8,769,873 B2 7/2014 Feng et al.
8,800,206 B2 8/2014 Vaknin et al.
8,857,015 B2 10/2014 Hufen et al.
8,915,020 B2 12/2014 Sauter
9,359,804 B2 * 6/2016 Dickson ..... E05F 15/60
9,957,742 B2 * 5/2018 Zimmer ..... E06B 3/4636
2001/0011579 A1 8/2001 Davies et al.
2001/0027621 A1 10/2001 Davies et al.
2005/0172563 A1 * 8/2005 Komoda ..... A47H 5/0325 49/358
2006/0144529 A1 * 7/2006 Hemphill ..... E05F 15/641 160/188
2007/0277442 A1 12/2007 Dery et al.
2008/0163553 A1 7/2008 Liao
2009/0025296 A1 1/2009 Petner
2009/0320373 A1 * 12/2009 Payne ..... E05D 15/0617 49/50
2012/0198773 A1 * 8/2012 Younce ..... E05F 15/635 49/359
2012/0297683 A1 11/2012 Cavalcante
2014/0047768 A1 2/2014 Vaknin et al.
2015/0152676 A1 6/2015 Plummer
2017/0101816 A1 * 4/2017 Kozonasky ..... E05F 15/77

FOREIGN PATENT DOCUMENTS

FR 2786219 A1 * 5/2000 ..... E05F 15/641
JP 5138725 B2 * 2/2013
WO 0111173 A1 2/2001
WO 2005061833 A1 7/2005
WO 2015142055 A1 9/2015

* cited by examiner

POWERED SLIDING DOOR OPERATOR

CROSS-REFERENCE TO RELATED APPLICATION

This application claims priority to Provisional Application No. 62/409,539, filed Oct. 18, 2016, which is herein incorporated by reference in its entirety.

TECHNICAL FIELD

Various aspects of the instant disclosure relate to hardware for fenestration products, such as sliding glass patio doors. In some specific examples, the disclosure concerns apparatuses, systems, and methods for operating a fenestration assembly having a vent panel.

BACKGROUND

Arranging a motorized drive system with a fenestration assembly having a sliding vent panel may be beneficial. Sliding door actuators may be desirable for assisted operation of the sliding door.

SUMMARY

Various aspects of the present disclosure are directed toward systems, methods, and apparatuses that include an actuator for operating a fenestration assembly having a vent panel. The actuator may include an engagement section configured to contact a horizontal portion of the fenestration assembly and a drive assembly configured to actuate the engagement section and transport the vent panel within the fenestration assembly.

In addition, aspects of the present disclosure are directed toward systems, methods, and apparatuses that include an actuator apparatus for operating a fenestration assembly having a vent panel. The actuator may include at least one cylindrical portion configured to contact a horizontal portion of the fenestration assembly and, and a drive assembly having a motor configured to control the at least one cylindrical portion. The drive assembly may include a drive shaft configured to transmit torque from the motor to the at least one cylindrical portion and rotate the at least one cylindrical portion along the horizontal portion to transport the vent panel between an open position and a closed position within the fenestration assembly, and a pivot section configured to actuate and cause the at least one rotating member to contact the horizontal portion of the fenestration assembly in response to the torque of the motor.

Various aspects of the present disclosure may also be directed toward methods for operating a fenestration assembly having a vent panel. The methods may include actuating an engagement section to contact a horizontal portion of the fenestration assembly; and operating the engagement section to transport the vent panel within the fenestration assembly.

While multiple, inventive examples are specifically disclosed, various modifications and combinations of features from those examples will become apparent to those skilled in the art from the following detailed description. Accordingly, the disclosed examples are meant to be regarded as illustrative in nature and not restrictive.

Figure 1:
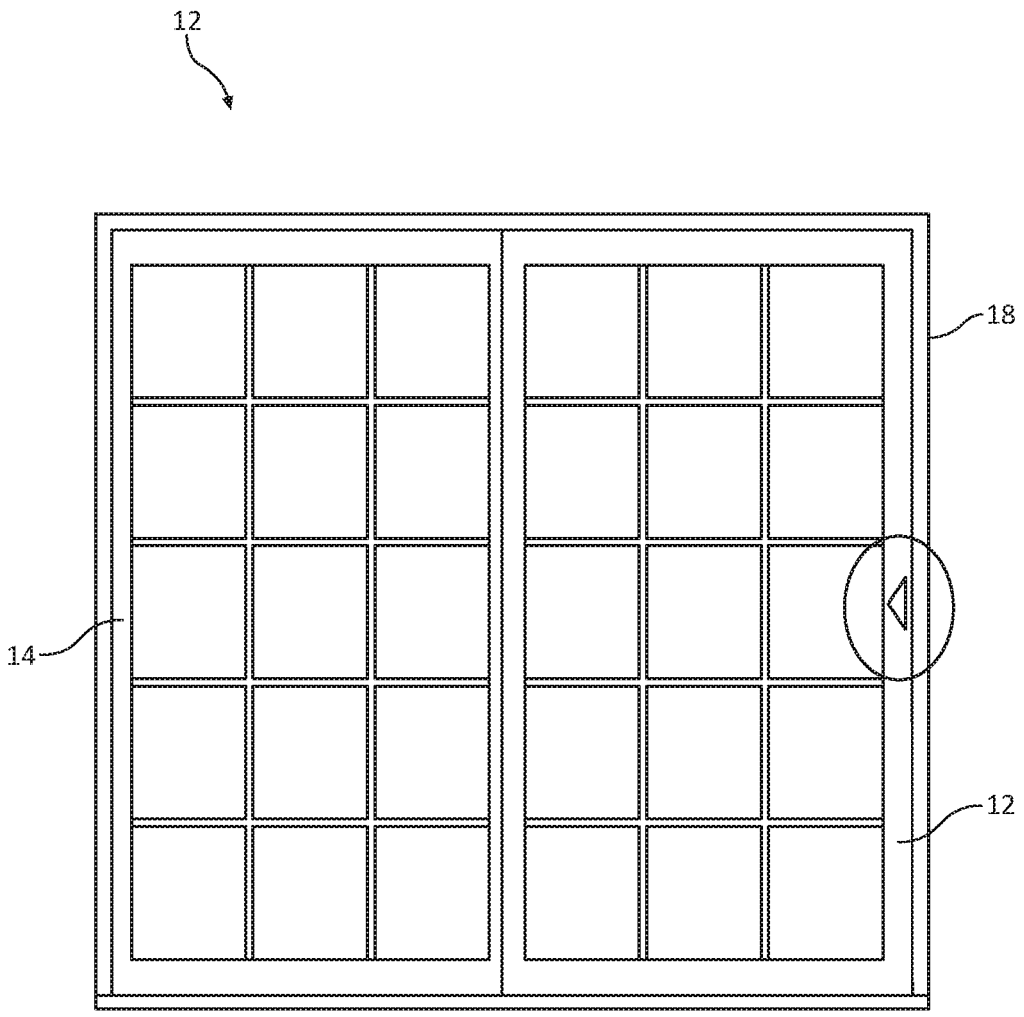
FIG. 1 is a schematic view of a fenestration assembly, according to some examples.

While the disclosure is amenable to various modifications and alternative forms, specific embodiments have been shown by way of example in the drawings and are described in detail below. The intention, however, is not to limit the disclosure to the particular embodiments described. On the contrary, the disclosure is intended to cover all modifications, equivalents, and alternatives falling within the scope of the disclosure as defined by the appended claims.

As the terms are used herein with respect to ranges of measurements (such as those disclosed immediately above), "about" and "approximately" may be used, interchangeably, to refer to a measurement that includes the stated measurement and that also includes any measurements that are reasonably close to the stated measurement, but that may differ by a reasonably small amount such as will be understood, and readily ascertained, by individuals having ordinary skill in the relevant arts to be attributable to measurement error, differences in measurement and/or manufacturing equipment calibration, human error in reading and/or setting measurements, adjustments made to optimize performance and/or structural parameters in view of differences in measurements associated with other components, particular implementation scenarios, imprecise adjustment and/or manipulation of objects by a person or machine, and/or the like.

DETAILED DESCRIPTION

Various aspects of the present disclosure are directed toward an actuator that may be used to open and close a vent panel of a fenestration assembly (such as a sliding door). The actuator may be motorized such that the vent panel may be opened and closed within the fenestration assembly without an operator (human, user) manually pushing or moving the vent panel.

FIG. 1 is a schematic view of a fenestration assembly 10 including a first panel 12, a second panel 14, and a frame 18, according to some examples. The first panel 12 is optionally a panel that opens by sliding, often termed a "vent" panel and the second panel 14 is a stationary panel, often termed a "fixed" panel. Panels of fenestration units (e.g., door panels) are often described in terms of vertical stiles and horizontal rails. Frames of fenestration units are often described in terms of vertical side jambs, a horizontal head, and a horizontal sill. Some examples of suitable fenestration units usable with locking systems according to the instant disclosure include those sold under the trade name "PRO-LINE 450 SERIES," "ARCHITECT SERIES," and "DESIGNER SERIES" by Pella Corporation of Pella, Iowa. In the usual manner, the first panel 12 is slidably mounted within a roller track, for example, horizontal movement between the jambs. Although the examples below are provided with reference to a sliding door, it should be understood that these features are equally applicable to a sliding window. As such, each example below should also be considered applicable to other types of fenestration units, such as sliding windows.

Figure 2:
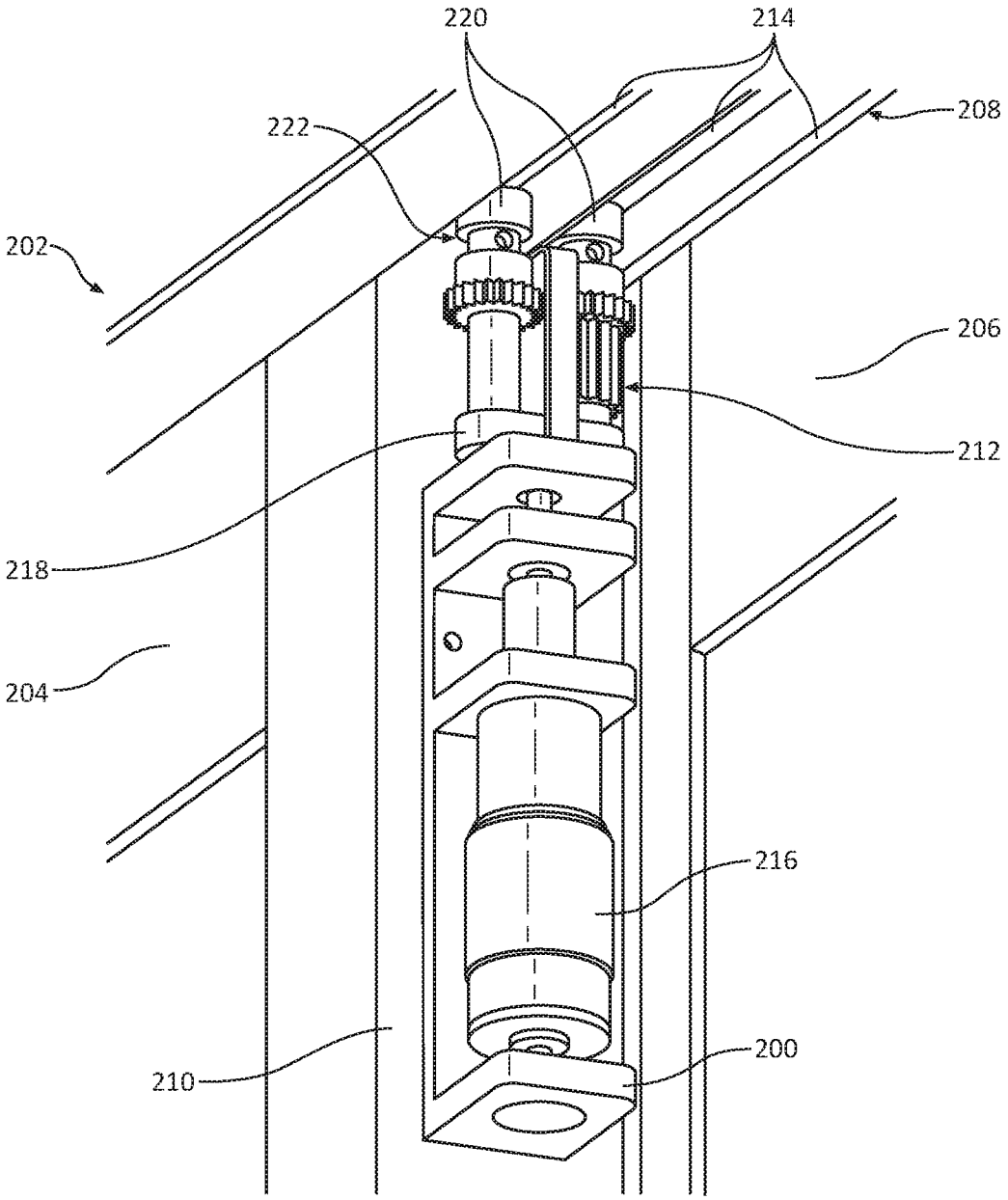
FIG. 2 is a perspective view of an actuator and fenestration assembly, according to some examples.

FIG. 2 is a perspective view of an actuator 200 and fenestration assembly 202, according to some examples. The fenestration assembly 202 may include a first panel 204 and a second panel 206. The first panel 204 may be a panel that opens by sliding (a "vent" panel) and the second panel 206 may be a stationary panel (a "fixed" panel). The fenestration assembly 202 may also include a horizontal head 208 and a horizontal sill and vertical jambs (not shown). The first panel 204 may be slidably mounted within a roller track of the fenestration assembly 202 for horizontal movement between the jambs. The actuator 200 may be arranged with the first panel 204. More specifically, the first panel 204 includes a vertical edge 210 on which the actuator 200 may be attached.

The actuator 200 is configured for operating the fenestration assembly 202. The actuator 200 may include an engagement section 212 configured to contact at least one horizontal portion 214 of the fenestration assembly 202. The horizontal portion 214, which the engagement section 212 is configured to contact, may be a portion of the head 208, as shown in FIG. 2, or the horizontal portion 214 may be a portion of the horizontal sill (not shown). In order operate or transport the first panel 204 within the fenestration assembly 202, the actuator 200 also includes a drive assembly 216. The drive assembly 216 may be configured to actuate the engagement section 212 and transport the first panel 204 within the fenestration assembly 202. In certain instances, the engagement section 212 is configured to contact the horizontal head 208 of the fenestration assembly 202 in response activation of the drive assembly 216. The engagement section 212 being configured in this manner may allow for manual operation of the first panel 204 within the fenestration assembly 202 without using the actuator 200. More specifically, the engagement section 212 being configured in this manner may mitigate against friction forces that result from the engagement section 212 contacting the horizontal portion 214, and allow for the ability of the user to manually transport the first panel 204.

To facilitate operation of the engagement section 212, the engagement section 212 may include a rotatable section 218 and a drive section 222. The rotatable section 218 is configured to rotate to cause the drive section 222 to contact the horizontal portion 214 of the fenestration assembly 202 in response activation of the drive assembly 216. The drive assembly 216, when power is applied thereto, operates and generates a force to rotate the rotatable section 216 from a position in which the engagement section 212 is not in contact with or coupled to the horizontal portion 214 of the fenestration assembly 202, to a position in which the engagement section 212 contacts the horizontal portion 214. In addition to rotating the rotatable section 216, the drive assembly 216 also provides an operating force to the drive section 222. The drive section 222, in turn, may transport the first panel 204 within the fenestration assembly 202.

In certain instances, the drive section 222 may include one or more frictional engagement portions 220*a, b* that are configured to rotate along the horizontal portion 214 of the fenestration assembly 202 to transport the first panel 204 within the fenestration assembly 202 in response to activation of the drive assembly 216. The frictional engagement portions 220*a, b* may be powered by the drive assembly 216 and rotate in response thereto. The frictional engagement portions 220*a, b* may rotate in either a clockwise or counterclockwise direction based on torque applied by the drive assembly 216 with the frictional engagement portions 220*a, b* rotating in opposite directions relative to one another. The frictional engagement portions 220*a, b* grip the horizontal portion 214 and rotate along the horizontal portion 214 to transport the first panel 204 in a first direction while rotating in a first setting, and transport the first panel 204 in a second direction while rotating in a second setting. The frictional engagement portions 220*a, b* having bi-directional rotation enables the actuator 200 to transport the first panel 204 between an open position and a closed position within the fenestration assembly 202 based on force applied by the drive assembly 216.

In certain instances, the frictional engagement portions 220*a, b* are formed by or coated with a material that enhances the ability of the frictional engagement portions 220*a, b* to grip the horizontal portion 214. The frictional engagement portions 220*a, b* may be formed from rubber, silicone, plastic, or any similar elastomer material. In addition, the frictional engagement portions 220*a, b* may include a silicone, rubber, or silicone-rubber coat to enhance the ability of the frictional engagement portions 220*a, b* to grip the horizontal portion 214. As noted above, the frictional engagement portions 220*a, b* may be powered to transport the first panel 204 between the open position and the closed position within the fenestration assembly 202. The drive assembly 216 may be configured to power the frictional engagement portions 220*a, b* accordingly in order to transport the first panel 204 between the open position and the closed position within the fenestration assembly 202.

Figure 3:
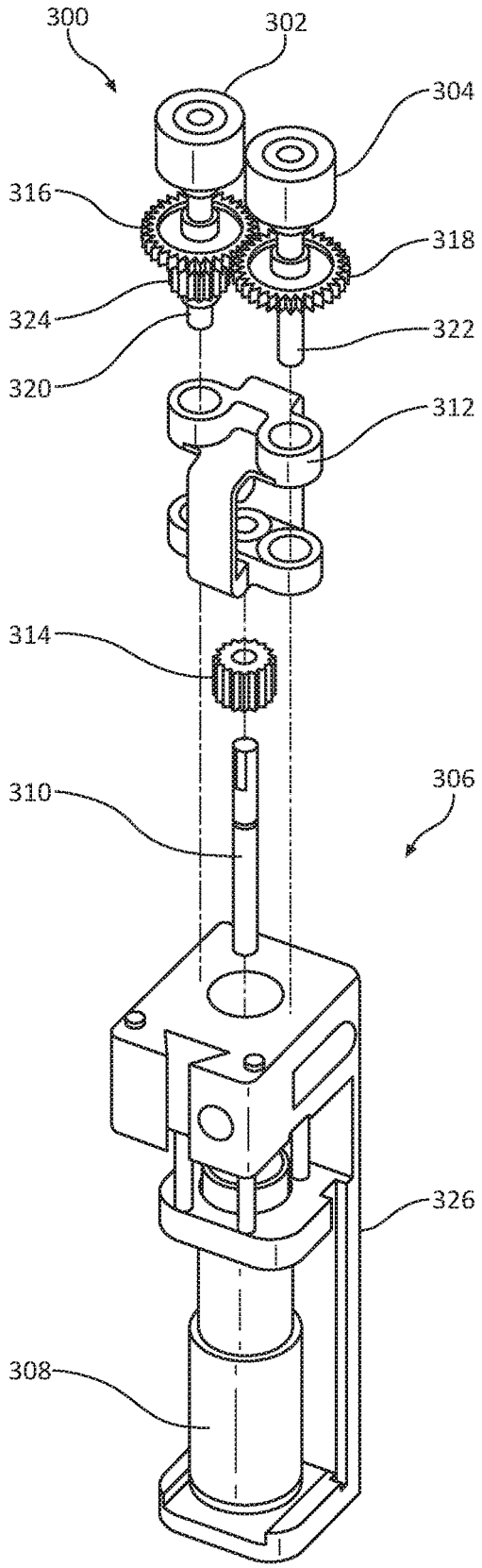
FIG. 3 is an exploded view of an actuator, according to some examples.

FIG. 3 is an exploded view of an actuator 300, according to some examples. The actuator 300 is configured for operating a fenestration assembly having a vent panel. The actuator 300 may include at least one cylindrical portion (or frictional engagement portion) configured to contact a horizontal portion of the fenestration assembly. As shown in FIG. 3, the actuator 300 includes two cylindrical portions 220*a*, 220*b* configured to contact the horizontal portion. The actuator 300 also includes a drive assembly 306 having a motor 216 (or drive assembly) configured to control the cylindrical portions 220*a*, 220*b*.

The drive assembly 306 may also include a drive shaft 310 and a pivot section 312. The drive shaft 310 may be directly coupled to the motor 216, and arranged partially through the pivot section 312. The drive shaft 310 may be configured to transmit torque from the motor 216 to the cylindrical portions 220*a*, 220*b* and rotate the cylindrical portions 220*a*, 220*b*. The pivot section 312 may house the cylindrical portions 220*a*, 220*b*.

When the actuator 300 is installed with the fenestration assembly, the cylindrical portions 220*a*, 220*b* are configured to rotate along a horizontal portion of the fenestration assembly to transport the vent panel between an open position and a closed position within the fenestration assembly. More specifically, the cylindrical portions 220*a*, 220*b* may grip the horizontal portion of the fenestration assembly and rotate to effect transport of the vent panel. The motor 216 is configured to effect rotation of the cylindrical portions 220*a*, 220*b*. More specifically, the drive assembly 306 may include a first gear 314 configured to transmit torque from the motor 216 to the cylindrical portions 220*a*, 220*b*. The first gear 314 (a pinion gear) is coupled to the drive shaft 310. The first gear 314 may include an internal aperture, through which the drive shaft 310 is arranged, for engagement between the first gear 314 and the drive shaft 310.

In certain instances, the drive assembly 306 also includes a second gear 316 and a third gear 318. The second gear 316 (a cluster gear) and the third gear 318 engage with one another such that rotation of one of the second gear 316 and the third gear 318 effects rotation of both the second gear 316 and the third gear 318. The second gear 316 and the third gear 318 may be respectively coupled to a second drive shaft 320 and a third drive shaft 322. The second drive shaft 320 and the third drive shaft 322 may also be respectively coupled to the cylindrical portions 220*a*, 220*b*. In addition, either the second gear 316 or the third gear 318 may include an extension section 324 that is configured to contact and engage with the first gear 314. As a result, rotation of the first gear 314, as caused by the drive shaft 310 via torque transmitted by the motor 216, may also rotate the second gear 316 and the third gear 318. Rotation of the second gear 316 and the third gear 318 effects rotation of the cylindrical portions 220*a*, 220*b*. The rotation of the cylindrical portions 220*a*, 220*b* transports the vent panel between an open position and a closed position within the fenestration assembly. The first gear 314 may be arranged within the pivot section 312 of the drive assembly 306 with the second gear 316 and the third gear 318 being arranged with the pivot section 312 via the second drive shaft 320 and the third drive shaft 322.

The pivot section 312 may also be coupled to the motor 216 through the drive shaft 310. In certain instances, the drive shaft 310 may be slip fit through a portion of the pivot section 312. In certain instances, the pivot section 312 includes bearings in to allow low friction rotation of drive shaft 310, the second drive shaft 320, and the third drive shaft 322. In addition, the pivot section 312 may be configured to actuate in response to the torque of the motor 216. More specifically, the motor 216 operates and applies a rotational force to the drive shaft 310. In response to rotation of the drive shaft 310, the pivot section 312 may also rotate. When the actuator 300 is installed with the fenestration assembly, the pivot section 312 may be biased into a neutral state such that the cylindrical portions 220*a*, 220*b* do not contact the horizontal portion of the fenestration assembly. In response to activation of the motor 216, the drive shaft 310 is configured to transmit torque from the motor 216 to rotate the cylindrical portions 220*a*, 220*b* and rotate the pivot section 312 to cause the cylindrical portions 220*a*, 220*b* to contact the horizontal portion of the fenestration assembly. The cylindrical portions 220*a*, 220*b* rotate in opposite directions relative to each other. As noted above, the motor 216 may be bi-directional and may rotate the draft shaft 310 in a counterclockwise and a clockwise direction. The rotation of the cylindrical portions 220*a*, 220*b* and the pivot section 312 transports the vent panel between an open position and a closed position within the fenestration assembly.

The actuator 300 may also include a housing 326 in which the motor 216 may be arranged. The housing 326 may be mounted to a vertical portion of the vent panel. The housing 326 may be coupled to the pivot section 312. In addition, the housing 326 may include an opening or aperture through which the drive shaft 310 extends.

The housing 326 may include control circuitry that may control the actuator 300. The control circuitry may also be configured to communicate with a controller using wireless control signals (e.g., radio frequency (RF), Bluetooth, Wi-Fi) that may power on the actuator 300. The control circuitry may interact with a sensor (e.g., wireless sensor system) and/or lock assembly.

The illustrative components shown in FIG. 3 are not intended to suggest any limitation as to the scope of use or functionality of embodiments of the disclosed subject matter. Neither should the illustrative components be interpreted as having any dependency or requirement related to any single component or combination of components illustrated therein. Additionally, any one or more of the components depicted in any of the FIG. 3 may be, in embodiments, integrated with various other components depicted therein (and/or components not illustrated), all of which are considered to be within the ambit of the disclosed subject matter. For example, the gear mechanism described with reference to FIG. 3 may be used in connection with actuators 200, 400, 500, or 600.

Figure 4A:
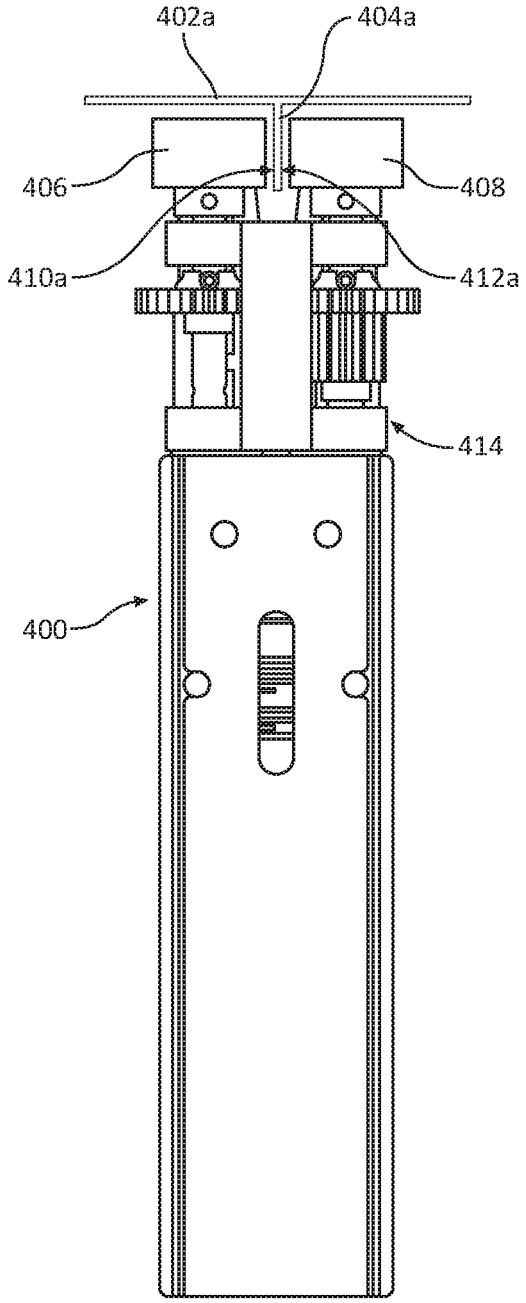
FIG. 4A is a side view of an actuator mounted in a head portion of a fenestration assembly, according to some examples.

FIG. 4A is a side view of an actuator 400 mounted in a head portion 402*a* of a fenestration assembly, according to some examples. Although only the head portion 402*a* is shown in FIG. 4A, the fenestration assembly includes a first panel (a "vent" panel) that slides within the fenestration assembly and along the head portion 402*a* and a second panel (a "fixed" panel) that may be a stationary panel. The fenestration assembly also includes a horizontal sill and vertical jambs (not shown). The head portion 402*a*, the horizontal sill, and the vertical jambs may be formed from wood, fiberglass, vinyl, or other similar materials. The actuator 400 may be arranged with the vent panel to slide the vent panel within a roller track of the fenestration assembly for horizontal movement between the jambs.

The actuator 400 may include rollers 220*a*, 220*b* (or cylindrical portions or frictional engagement portions) that are configured to contact and engage at least one horizontal portion of the head portion 402*a* of the fenestration assembly. As shown in FIG. 4A, the rollers 220*a*, 220*b* are arranged on either side of the horizontal portion 404*a*. The rollers 220*a*, 220*b* may be configured to rotate in response to a torque from a motor (not shown) and grip the horizontal portion 404*a*. The rollers 220*a*, 220*b* may grip the horizontal portion 404*a* and rotate along the horizontal portion 404*a* while transporting the vent panel along therewith. The rollers 220*a*, 220*b*, however, may be configured to contact the horizontal portion 404*a* in response to activation of the motor. More specifically and as shown in FIG. 4A, the rollers 220*a*, 220*b* do not contact the horizontal portion 404*a* in an unactivated or neutral state. In the unactivated or neutral state shown in FIG. 4A, gaps 410*a*, 412*a* exist between the rollers 220*a*, 220*b* and the horizontal portion 404*a*. As a result of the rollers 220*a*, 220*b* not being in contact with the horizontal portion 404*a* in the unactivated or neutral state, an operator (e.g., human or user) may manually slide the vent panel within the assembly without being hindered or blocked by the frictional engagement of the rollers 220*a*, 220*b* and the horizontal portion 404*a*.

To facilitate operation the actuator 400 and engagement of the rollers 220*a*, 220*b* with the horizontal portion 404*a*, the actuator 400 includes a pivot section 312. When the actuator 400 is activated and power is applied thereto, the motor operates and generates a torque to rotate the pivot section 312 from a position in which the rollers 220*a*, 220*b* are not in contact with or coupled to the horizontal portion 404*a* to a position in which the rollers 220*a*, 220*b* contact the horizontal portion 404*a*. Once the rollers 220*a*, 220*b* contact and are engaged with the horizontal portion 404*a*, the rollers 220*a*, 220*b* are configured to rotate along the horizontal portion 404*a* to transport the vent panel within the fenestration assembly. The rollers 220*a*, 220*b* may be powered by the motor and rotate in response thereto.

In addition, the rollers 220*a*, 220*b* may rotate in either a clockwise or counterclockwise direction based torque applied by the motor of the actuator 400. The rollers 220*a*, 220*b* are configured to rotate in opposite directions relative to one another. The rollers 220*a*, 220*b* grip the horizontal portion 404*a* and rotate along the horizontal portion 404*a* to transport the vent panel in a first direction while rotating in a first setting, and transport the vent panel in a second direction while rotating in a second setting (e.g., as described in further detail with reference to FIGS. 7A-B). The rollers 220*a*, 220*b* having bi-directional rotation enables the actuator 400 to transport the vent panel between an open position and a closed position within the fenestration assembly.

Figure 4B:
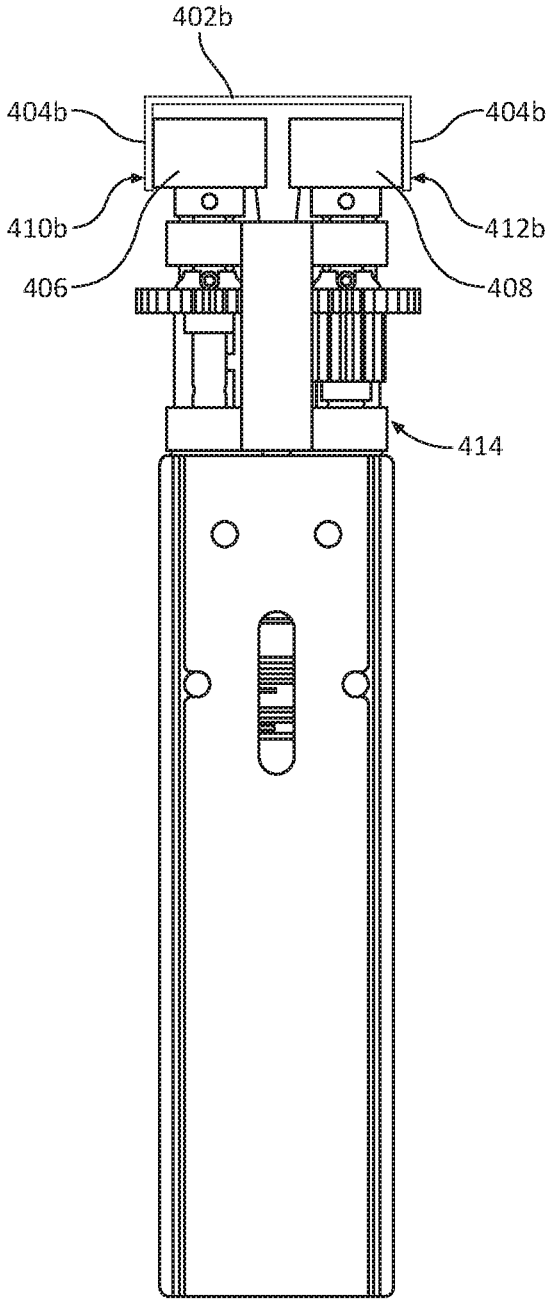
FIG. 4B is a side view of the actuator, shown in FIG. 4A, mounted in another head portion of a fenestration assembly, according to some examples.

FIG. 4B is a side view of the actuator 400, shown in FIG. 4A, mounted in another head portion 402*b* of a fenestration assembly, according to some examples. As shown in FIG. 4B, the head portion 402*b* includes two horizontal portions 404*b*. The rollers 220*a*, 220*b* are arranged between the horizontal portions 404*b*. The rollers 220*a*, 220*b* may also be biased in an unactivated or neutral state and not contact or engage with the horizontal portions 404*b* until the actuator 400 is activated. As shown in FIG. 4B, gaps 410*b*, 412*b* exist between the rollers 220*a*, 220*b* and the horizontal portions 404*b*.

Figure 5A:
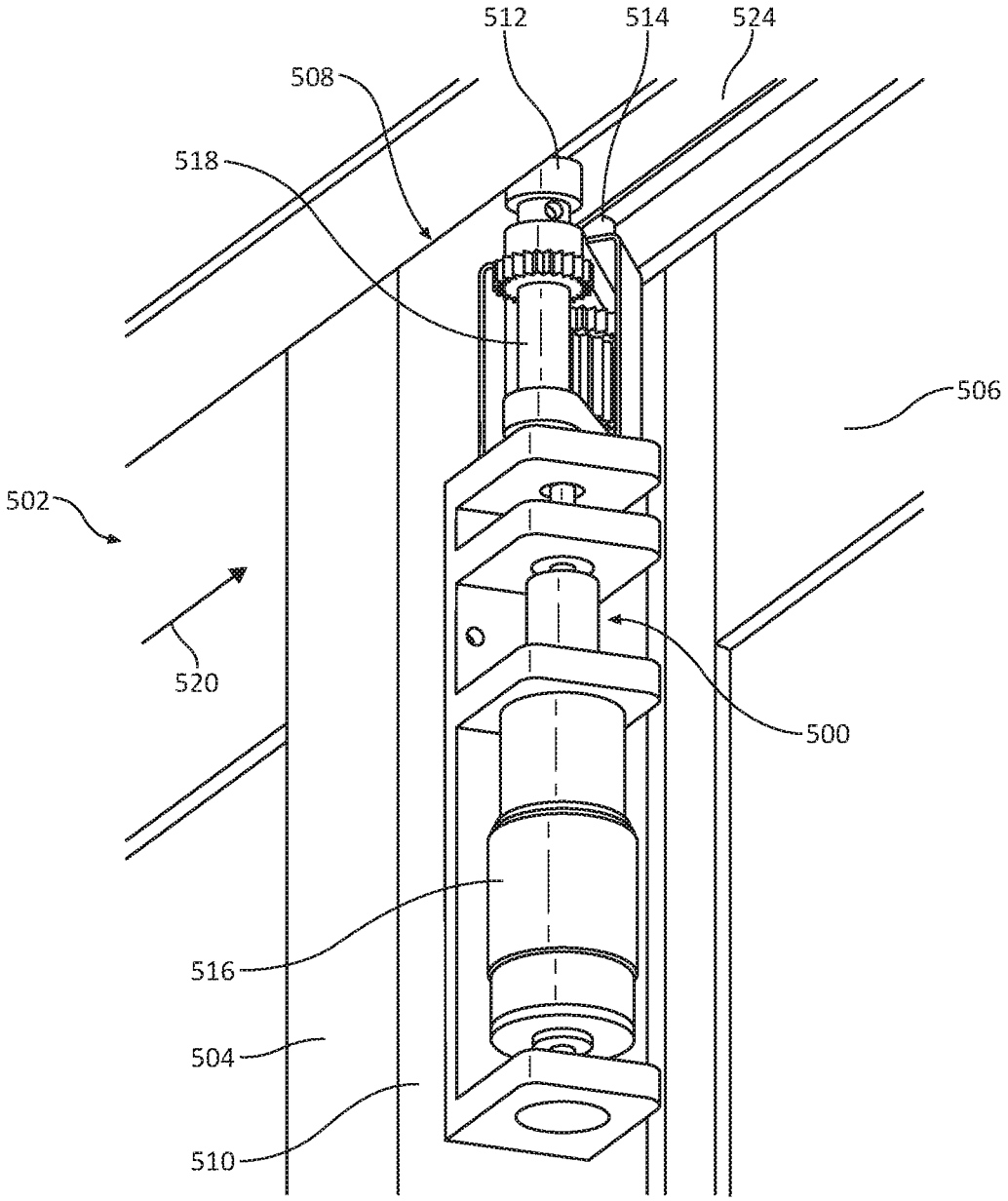
FIG. 5A is an illustration of an actuator, arranged with a fenestration assembly, in a first configuration, according to some examples.

FIG. 5A is an illustration of an actuator 500, arranged with a fenestration assembly 202, in a first configuration, according to some examples. The fenestration assembly 202 includes a vent panel 504 that slides within the fenestration assembly 202 and along a head portion 208, and a fixed panel 506 that may be a stationary panel. The fenestration assembly 202 also includes a horizontal sill and vertical jambs (not shown). The fenestration assembly 202 may also include a roller track (not shown) for horizontal movement of the vent panel 504 between the jambs.

The vent panel 504 includes a vertical frame (or stile) 510 upon which the actuator 500 may be mounted. The actuator 500 may be mounted on the vertical frame 510 of the vent panel 504 on an upper section thereof to facilitate the actuator 500 engaging with the head portion 208. In other instances, the actuator 500 may be mounted on the vertical frame 510 of the vent panel 504 on an lower section thereof to facilitate the actuator 500 engaging with the horizontal sill. In certain instances, the actuator 500 may engage with a horizontal portion 524 of the head portion 208.

The actuator 500 may include rollers 220*a*, 220*b* (or cylindrical portions or frictional engagement portions) that are configured to contact and grip the horizontal portion 524 of the head portion 208 of the fenestration assembly 202. The rollers 220*a*, 220*b*, arranged on either side of the horizontal portion 524, rotate in response to a torque from a motor 216 and grip the horizontal portion 524. The rollers 220*a*, 220*b* grip the horizontal portion 524 and rotate along the horizontal portion 524 while transporting the vent panel 504 along therewith. The rollers 220*a*, 220*b* may be configured to contact the horizontal portion 524 in response to activation of the motor 216.

In response to activation of the motor 216, each of the rollers 220*a*, 220*b* and a pivot section 312 rotate. When the actuator 500 is activated and power is applied thereto, the motor 216 operates and generates a torque to rotate the pivot section 312 from a position in which the rollers 220*a*, 220*b* are not in contact with or grip to the horizontal portion 524 to a position in which the rollers 220*a*, 220*b* contact the horizontal portion 524. Once the rollers 220*a*, 220*b* contact and are engaged with the horizontal portion 524, the rollers 220*a*, 220*b* grip and rotate along the horizontal portion 524 to transport the vent panel 504 within the fenestration assembly 202.

In addition, the rollers 220*a*, 220*b* may rotate based on torque applied by the motor 216 of the actuator 500. The rollers 220*a*, 220*b* grip the horizontal portion 524 and rotate along the horizontal portion 524 to transport the vent panel 504 in a first direction 520 (shown in FIG. 5A) while rotating in one of the clockwise or counterclockwise direction, and transport the vent panel 504 in a second direction 522 (shown in FIG. 5B) while rotating in the other of the clockwise or counterclockwise direction. The rollers 220*a*, 220*b* having bi-directional rotation enables the actuator 500 to transport the vent panel 504 between an open position and a closed position within the fenestration assembly 202.

Figure 5B:
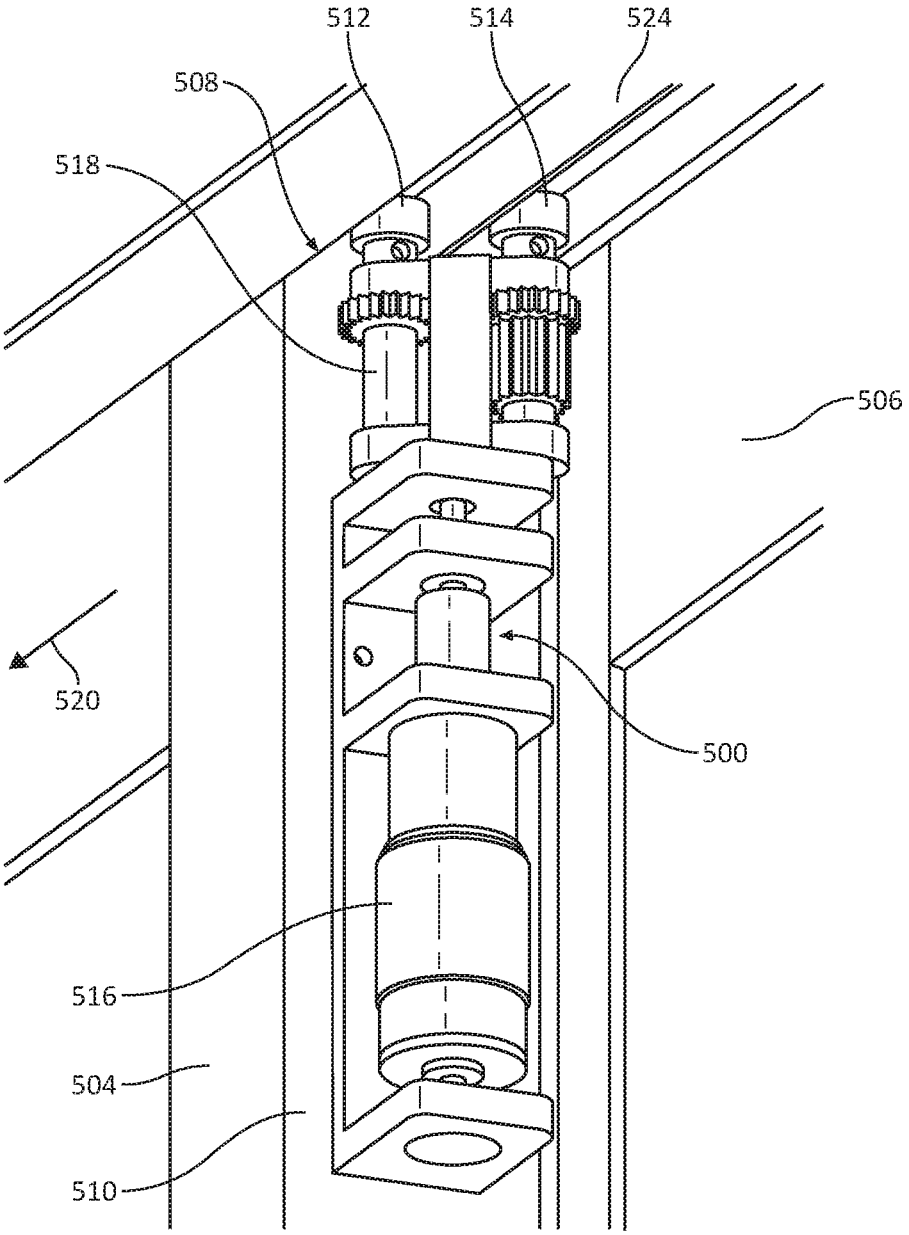
FIG. 5B is an illustration of the actuator, shown in FIG. 5A, in a second configuration, according to some examples.

As shown in FIG. 5A, for example, the pivot section 312 rotates in a first direction to engage the rollers 220*a*, 220*b* with the horizontal portion 524 to transport the vent panel 504 in the first direction 520. As shown in FIG. 5B, the pivot section 312 rotates in a second direction, opposite that of the first direction, to engage the rollers 220*a*, 220*b* with the horizontal portion 524 to transport the vent panel 504 in the second direction 522. The motor 216 and actuator 500 may be concealed and imbedded into the vertical frame 510 of the vent panel 504.

Figure 6:
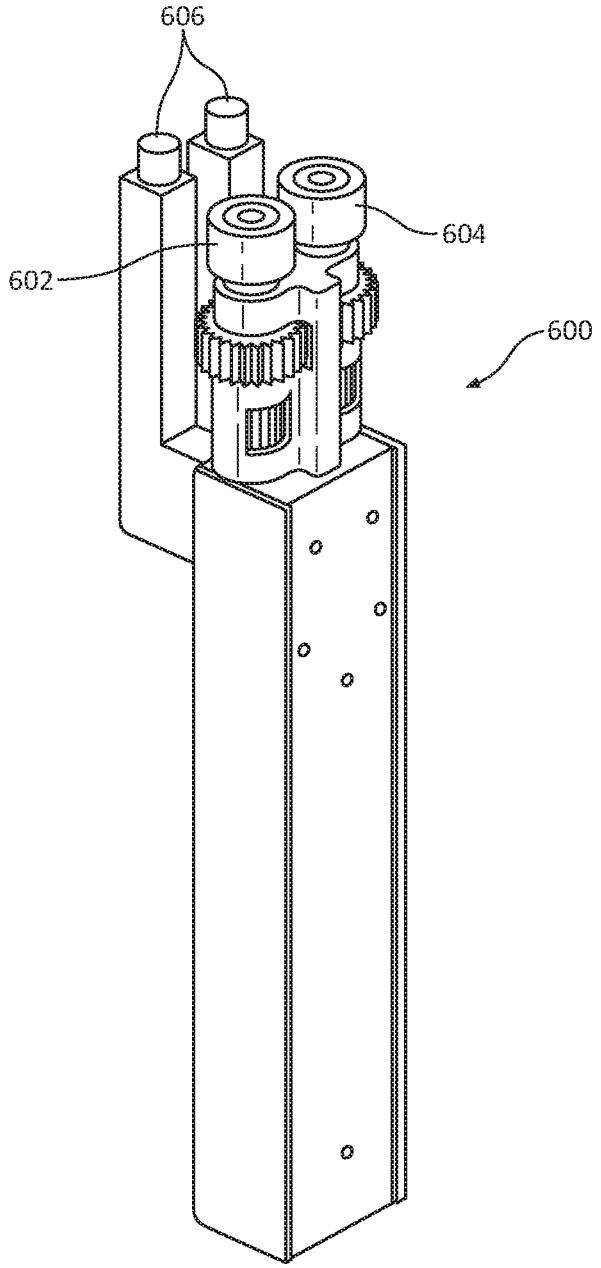
FIG. 6 is a perspective view of another actuator, according to some examples.

FIG. 6 is a perspective view of another actuator 600, according to some examples. The actuator 600 may include rollers 602, 604 that are configured to contact and engage at least one horizontal portion of a head portion of a fenestration assembly. The rollers 602, 604 may be configured to rotate in response to a torque from a motor (not shown) and grip the horizontal portion.

To facilitate operation of the actuator 600 and the rollers 602, 604, the actuator 600 may interface with an electrical power controller arranged with the fenestration assembly and configured to transmit power to the motor. The power controller includes an electrically conductive strip arranged within the fenestration assembly and configured to transmit power. To interface with the power controller, the actuator 600 may include one or more conductive portions 606 configured to contact the conductive strip and pass the power from the power controller to the motor of the actuator 600. The conductive portions 606 may be carbon pick-ups and the conductive strip may be a stainless steel strip that interfaces with an electrical unit to transmit power therealong.

The illustrative components shown in FIG. 6 are not intended to suggest any limitation as to the scope of use or functionality of embodiments of the disclosed subject matter. Neither should the illustrative components be interpreted as having any dependency or requirement related to any single component or combination of components illustrated therein. Additionally, any one or more of the components depicted in any of the FIG. 6 may be, in embodiments, integrated with various other components depicted therein (and/or components not illustrated), all of which are considered to be within the ambit of the disclosed subject matter. For example, the power controller described with reference to FIG. 6 may be used in connection with actuators 200, 300, 400, or 500.

Figure 7A:
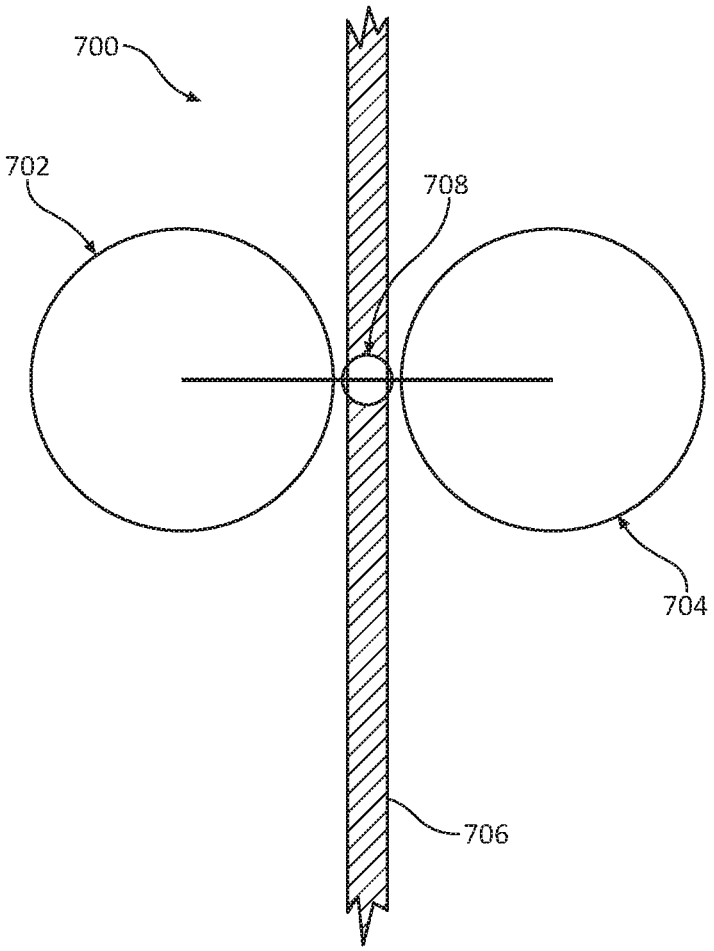
FIG. 7A is a simplified diagram of an actuator and portion of a fenestration assembly in a neutral configuration, according to some examples.
Figure 7B:
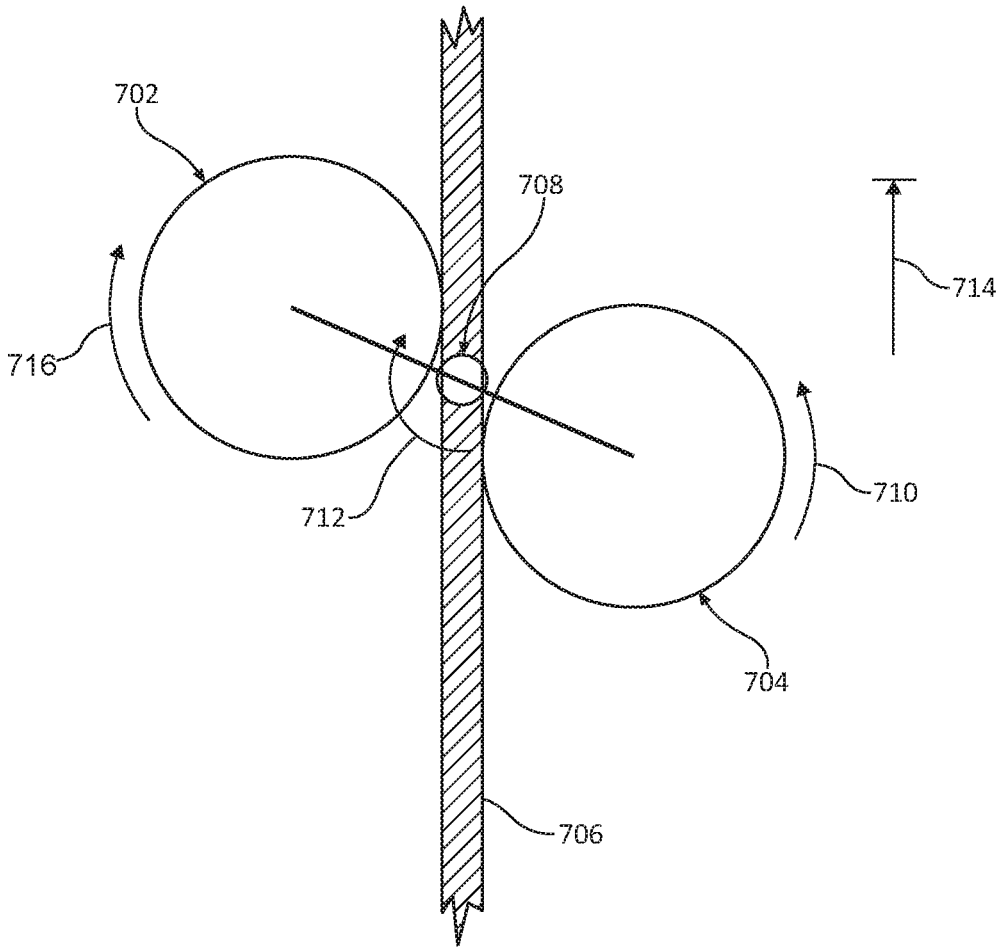
FIG. 7B is the actuator, shown in FIG. 7A, and the portion of the fenestration assembly in a moving configuration, according to some examples.

FIG. 7A is a simplified diagram of an actuator 700 and portion 706 of a fenestration assembly in a neutral configuration, according to some examples. The actuator 700 may include rollers 702, 704 that are configured to contact and engage at least one horizontal portion 706 of a head portion of a fenestration assembly. The actuator 700 may be coupled to a vertical section of a vent panel to affect movement thereof. The rollers 702, 704 may be configured to rotate in response to a torque from a motor (not shown) and grip the horizontal portion 706. The rollers 702, 704 are coupled to the motor via an input shaft 708. In the neutral configuration, the rollers 702, 704 are not in contact with the horizontal portion 706. As shown in FIG. 7B, the rollers 702, 704 contact the horizontal portion 706 in response to torque from the motor.

As shown in FIG. 7B, the rollers 702, 704 are engaged with the horizontal portion 706. The rollers 702, 704 are pivoted in direction 712 to engage with the horizontal portion 706 (e.g., as discussed above with reference to FIG. 5A-5B). The rollers 702, 704 rotate in opposite directions 710, 716 and grip the horizontal portion 706 to affect movement of the vent panel, to which the actuator 700 is attached, in a first direction 714. The rollers 702, 704 may be rotated opposite the directions 710, 716 to affect movement of the vent panel in a second direction (opposite of the first direction 714).

Figure 7C:
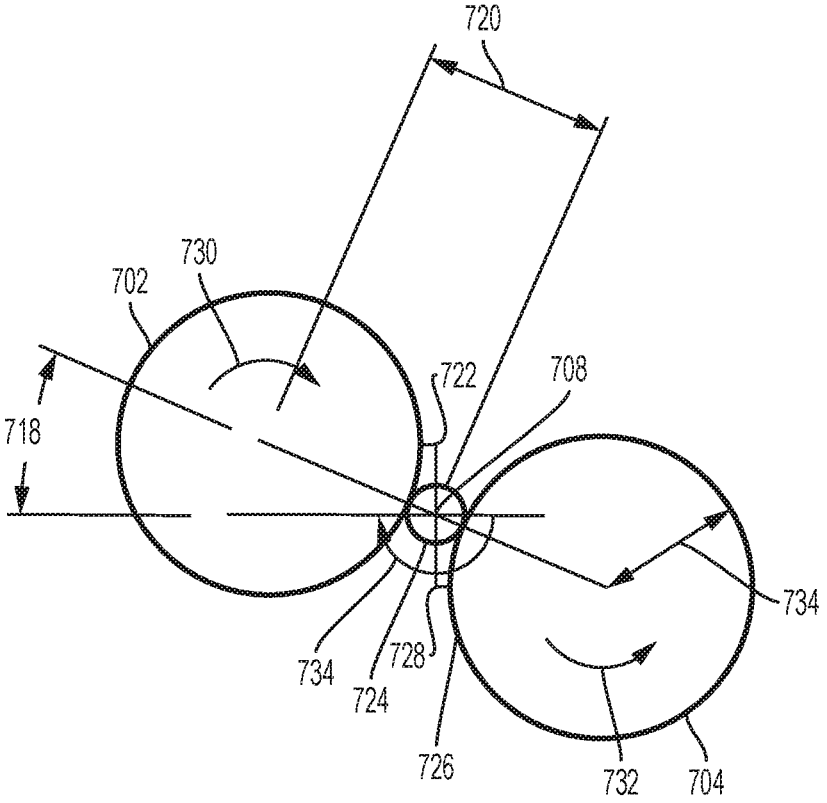
FIG. 7C is the actuator, shown in FIGS. 7A-B showing various forces and moments that occur during operation, according to some examples.

FIG. 7C shows the various forces and moments that occur during operation of the rollers 702, 704. As a result of the rollers 702, 704 pivoting, as shown in FIG. 7B, the rollers 702, 704 are angled 718 relative to the neutral configuration shown in FIG. 7A. In addition, the rollers 702, 704 are separated by a length 720 from the input shaft 708. As noted above, the rollers 702, 704 may be configured to rotate in response to a torque from a motor (not shown) and grip the horizontal portion 706. Forces 722, 724, 726, 728 occur on the rollers 702, 702 as a result of the torque from the motor, which creates moments 730, 732 of the rollers 702, 702 to affect pivoting of the rollers 702, 702. The forces 722, 724, 726, 728 effect friction between the rollers 702, 704 the horizontal portion 706 to affect movement of the vent panel. The moments 730, 732 and forces 722, 724, 726, 728 may be calculated based on the length 720 and a radius 734 of the rollers 702, 702.

Figure 8A:
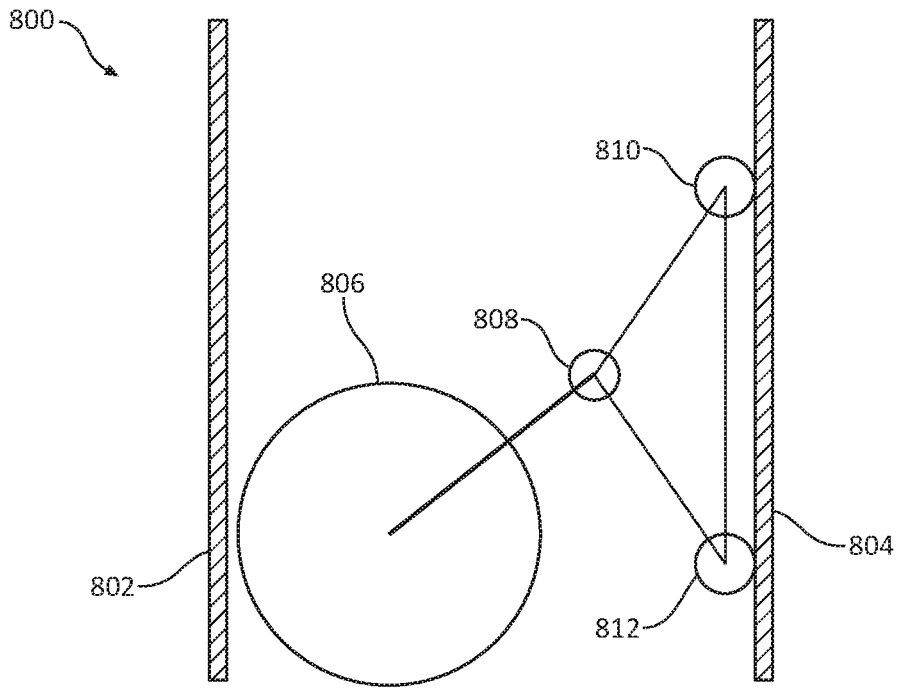
FIG. 8A is a simplified diagram of an actuator and channel walls of a fenestration assembly in a neutral configuration, according to some examples.

FIG. 8A is a simplified diagram of an actuator 800 and channel walls 802, 804 of a fenestration assembly in a neutral configuration, according to some examples. The actuator 800 may include a drive roller 806 that is configured to contact and engage one of the channel walls 802, 804 of a head portion of a fenestration assembly. The actuator 800 may be coupled to a vertical section of a vent panel to affect movement thereof. The drive roller 806 may be configured to rotate in response to a torque from a motor (not shown) transmitted via an input shaft 808. The drive roller 806 does not contact the channel walls 802, 804 in the neutral position, and is configured to contact one of the channel walls 802, 804 in response to torque from the motor. The actuator 800 may also include reaction rollers 810, 812 that contact the opposite one of the channel walls 802, 804 that the drive roller 806 is configured to contact. The reaction rollers 810, 812 may remain in contact with one of the channel walls 802, 804 in the neutral position and the moving position.

Figure 8B:
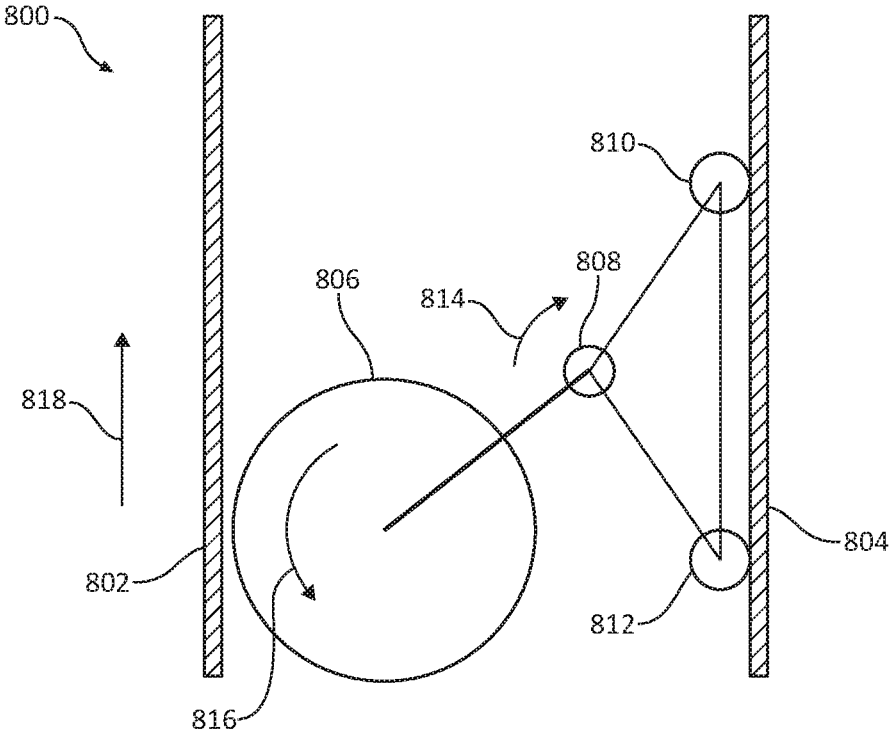
FIG. 8B is the actuator, shown in FIG. 8A, and the channel walls of the fenestration assembly in a moving configuration, according to some examples.

As shown in FIG. 8B, the drive roller 806 is engaged with the one of the channel walls 802, 804 in response to torque from the motor. The drive roller 806 pivots 814 from the input shaft 808 to engage with the one of the channel walls 802, 804. The roller 806 is configured to rotate 816 and grip the one of the channel walls 802, 804 to affect movement of the vent panel, to which the actuator 800 is attached, in a first direction 818. The drive roller 806 may be rotated in the opposite direction to affect movement of the vent panel in a second direction (opposite of the first direction 718). The reaction rollers 810, 812 may remain in contact with one of the channel walls 802, 804 and facilitate the drive roller 806 contacting and engaging with the other of the channel walls 802, 804.

Figure 8C:
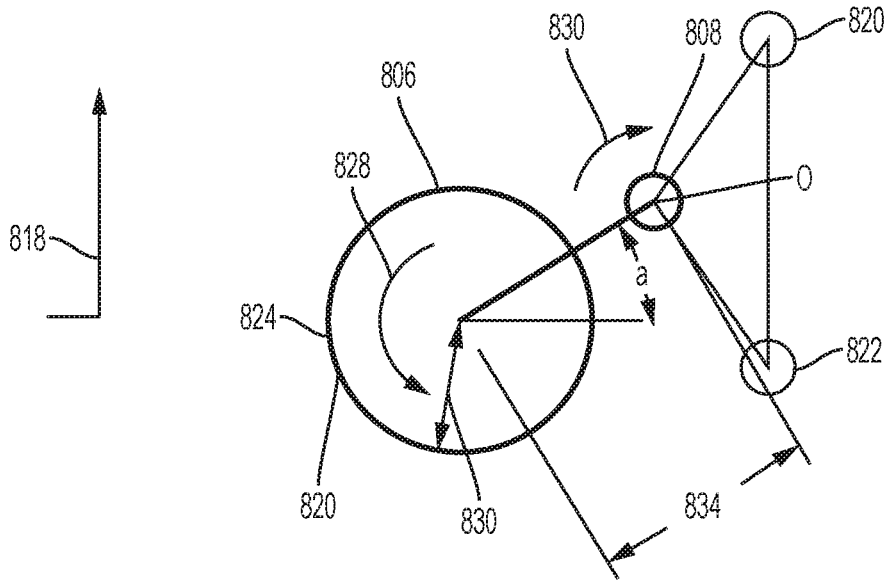
FIG. 8C is the actuator, shown in FIGS. 8A-B showing various forces and moments that occur during operation, according to some examples.

FIG. 8C shows the various forces and moments that occur during operation of the drive roller 806 and reaction rollers 810, 812. As a result of the torque from a motor (not shown) transmitted via an input shaft 808, forces 820, 822, 824, 826 occur between the drive roller 806 and reaction rollers 810, 812 and the channel walls 802, 804. The forces 820, 822, 824, 826 effect friction between the drive roller 806 and reaction rollers 810, 812 and the channel walls 802, 804 to affect movement of the vent panel. Forces 820, 822, 824, 826 occur on the drive roller 806 and reaction rollers 810, 812 as a result of the torque from the motor, which creates moments 828, 830 to affect the movement of the vent panel. The forces 820, 822, 824, 826 and moments 828, 830 may be calculated based on a radius 832 of the drive roller 806 and a length 834 between the drive roller 806 and the input shaft 808.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the described features. Accordingly, the scope of the present disclosure is intended to embrace all such alternatives, modifications, and variations as fall within the scope of the claims, together with all equivalents thereof.

We claim:

1. An actuator apparatus for operating a fenestration assembly having a vent panel, the apparatus comprising:

an engagement section configured to contact a horizontal portion of the fenestration assembly, the engagement section including frictional engagement portions; and a drive assembly configured to rotate the engagement section about the drive assembly between a neutral position in which the frictional engagement portions are not in contact with the horizontal portion and a contact position in which the frictional engagement portions are in contact with the horizontal portion of the fenestration assembly and in the contact position the drive assembly rotates the frictional engagement portions to transport the vent panel within the fenestration assembly, wherein the engagement section is biased to the neutral position.

2. The apparatus of claim 1, wherein the engagement section is configured to contact the horizontal portion of the fenestration assembly in response activation of the drive assembly.

3. The apparatus of claim 2, wherein the engagement section includes a rotatable section and a drive section, and the rotatable section is configured to rotate to cause the drive section to contact the horizontal portion of the fenestration assembly in response activation of the drive assembly.

4. The apparatus of claim 3, wherein the frictional engagement portions are configured to rotate along the horizontal portion of the fenestration assembly to transport the vent panel within the fenestration assembly in response activation of the drive assembly.

5. The apparatus of claim 4, wherein the frictional engagement portions comprises dual powered elastomer coated rollers configured to grip and rotate along the horizontal portion of the fenestration assembly to transport the vent panel within the fenestration assembly in response activation of the drive assembly.

6. The apparatus of claim 1, wherein the horizontal portion of the fenestration assembly comprises a portion of a head or sill of the fenestration assembly.

7. The apparatus of claim 1, wherein the drive assembly and the engagement section are arranged with the vent panel.

8. The apparatus of claim 7, wherein the drive assembly and the engagement section are attached to a vertical edge of the vent panel.

9. The apparatus of claim 1, wherein the vent panel is a sliding door, and the drive assembly is configured to actuate the engagement section and transport the vent panel between an open position and a closed position within the fenestration assembly.

10. An actuator apparatus for operating a fenestration assembly having a vent panel, the apparatus comprising:

at least one cylindrical portion configured to contact a horizontal portion of the fenestration assembly; and a drive assembly having a motor configured to control the at least one cylindrical portion, the drive assembly including:

a drive shaft configured to transmit torque from the motor to the at least one cylindrical portion and rotate the at least one cylindrical portion along the horizontal portion to transport the vent panel between an open position and a closed position within the fenestration assembly, and a pivot section configured to rotate about the drive shaft and cause the at least one cylindrical portion to rotate from a biased neutral position in which the at least one cylindrical portion is not in contact with the horizontal portion to a contact position in which the at least one cylindrical portion is in contact with the horizontal portion of the fenestration assembly in response to the torque of the motor.

11. The apparatus of claim 10, wherein the drive assembly includes at least one gear configured to transmit torque from the motor to the at least one cylindrical portion.

12. The apparatus of claim 10, wherein the drive shaft is configured to transmit torque from the motor to rotate the at least one cylindrical portion and the pivot section to cause the at least one cylindrical portion to contact the horizontal portion of the fenestration assembly.

13. The apparatus of claim 10, wherein the motor is configured to rotate the at least one cylindrical portion in a first direction of rotation and a second direction of rotation.

14. The apparatus of claim 13, wherein motor is configured rotate the at least one cylindrical portion and transport the vent panel toward the open position in the first direction of rotation and toward the closed position in the second direction of rotation.

15. The apparatus of claim 10, further comprising an electrical power controller arranged with the fenestration assembly and configured to transmit power to the motor.

16. The apparatus of claim 15, wherein the electrical power controller includes a conductive strip arranged within the fenestration assembly and configured to transmit power, and the drive assembly includes at least one conductive portion configured to contact the conductive strip and pass the power from the power controller to the motor.

17. The apparatus of claim 15, wherein the at least one cylindrical portion is configured to contact the horizontal portion of the fenestration assembly and a second horizontal portion of the fenestration assembly, the horizontal portion and the second horizontal portion forming a channel, and the electrical power controller includes a conductive strip arranged within the channel and is configured to transmit power, and the drive assembly includes at least one conductive portion configured to contact the conductive strip and pass the power from the power controller to the motor.

18. The apparatus of claim 10, wherein the at least one cylindrical portion is configured to contact the horizontal portion of the fenestration assembly and a second horizontal portion of the fenestration assembly, the horizontal portion and the second horizontal portion forming a channel, and the at least one cylindrical portion is self-locking in response to a friction between the at least one cylindrical portion and the channel.

19. A method for operating the actuator of claim 1, the method comprising:

actuating the drive assembly to rotate the engagement section to the contact position; and operating the engagement section to transport the vent panel within the fenestration assembly by rotating the frictional engagement portions.

20. The method of claim 19, wherein actuating the engagement section includes rotating the engagement section from the neutral position to the contact position.

21. The method of claim 20, wherein operating the engagement section includes rotating the frictional engagement portions along the horizontal portion of the fenestration assembly to transport the vent panel.

22. The method of claim 21, wherein the frictional engagement portions rotate in a opposite directions.

* * * * *